US010473395B2

(12) United States Patent
Fliegl, Jr.

(10) Patent No.: US 10,473,395 B2
(45) Date of Patent: Nov. 12, 2019

(54) DRIER

(71) Applicant: Fliegl Agrartechnik GmbH, Muhldorf am Inn (DE)

(72) Inventor: Josef Fliegl, Jr., Muhldorf am Inn (DE)

(73) Assignee: FLIEGL AGRARTECHNIK GMBH, Muhldorf am Inn (DE)

( * ) Notice: Subject to any disclaimer, the term of this patent is extended or adjusted under 35 U.S.C. 154(b) by 66 days.

(21) Appl. No.: 15/745,758

(22) PCT Filed: Mar. 7, 2017

(86) PCT No.: PCT/EP2017/055281
§ 371 (c)(1),
(2) Date: Jan. 18, 2018

(87) PCT Pub. No.: WO2017/162430
PCT Pub. Date: Sep. 28, 2017

(65) Prior Publication Data

US 2018/0209733 A1 Jul. 26, 2018

(30) Foreign Application Priority Data

Mar. 24, 2016 (DE) ..... 10 2016 105 538

(51) Int. Cl.
*F26B 11/04* (2006.01)
*F26B 17/00* (2006.01)
(Continued)

(52) U.S. Cl.
CPC ..... *F26B 11/0409* (2013.01); *F26B 11/04* (2013.01); *F26B 11/0472* (2013.01);
(Continued)

(58) Field of Classification Search
CPC ... F26B 11/0409; F26B 11/04; F26B 11/0472; F26B 11/0486; F26B 17/00; F26B 17/20; F26B 2200/12; F26B 2200/18
(Continued)

(56) References Cited

U.S. PATENT DOCUMENTS 2,460,008 A * 1/1949 Heller ..... F26B 17/106 241/154
4,071,962 A * 2/1978 Saeman ..... F26B 11/0477 34/135
(Continued)

FOREIGN PATENT DOCUMENTS

DE 1230703 12/1966
DE 202015105780 U1 * 11/2015 ..... F26B 11/04
(Continued)

OTHER PUBLICATIONS

International Search Report of PCT/EP2017/055281, dated Sep. 2017.

*Primary Examiner* — Stephen M Gravini
(74) *Attorney, Agent, or Firm* — Renner Kenner Greive Bobak Taylor & Weber

(57) ABSTRACT

A drying device for a mixture of a liquid and one or more solids, having a receiving container for the mixture, a rotor that is situated with one section of its circumference in the receiving container, and a drive device for rotatively driving the rotor, the rotor having a plurality of flat entrainment elements, characterized in that the entrainment elements have a radial orientation with respect to a rotational axis of the rotor, wherein at least some of the entrainment elements have a configuration in which relatively narrow entrainment elements alternate with relatively wide entrainment elements in the circumferential direction of the rotor, and/or at
(Continued)

Fig. 2 least some of the entrainment elements are provided with a plurality of through openings.

17 Claims, 4 Drawing Sheets

(51) Int. Cl.
*F26B 11/06* (2006.01)
*F26B 17/20* (2006.01)

(52) U.S. Cl.
CPC ..... *F26B 11/0486* (2013.01); *F26B 17/00* (2013.01); *F26B 17/20* (2013.01); *F26B 2200/12* (2013.01); *F26B 2200/18* (2013.01)

(58) Field of Classification Search
USPC ..... 34/89
See application file for complete search history.

(56) References Cited

U.S. PATENT DOCUMENTS 4,430,003 A * 2/1984 Beattie ..... B01F 5/22 118/303
5,143,308 A * 9/1992 Hally ..... B03B 5/28 209/44.1
5,157,849 A * 10/1992 Ronning ..... F26B 11/0477 34/135
5,570,517 A * 11/1996 Luker ..... F26B 17/20 34/136
5,638,606 A * 6/1997 Bryan ..... F26B 5/08 34/147
5,992,050 A * 11/1999 Kemper ..... F26B 3/00 34/237
6,065,224 A * 5/2000 Eigner ..... C05F 17/0247 34/135
6,138,375 A * 10/2000 Humphries, II ..... F26B 5/08 34/147
6,282,809 B1 * 9/2001 Sunde ..... F26B 5/04 34/135
7,024,794 B1 * 4/2006 Mynes ..... F26B 17/24 210/374
7,171,762 B2 * 2/2007 Roberts ..... B29B 9/16 34/166
7,819,576 B2 * 10/2010 Zeikus ..... B01F 3/04113 366/102
8,037,618 B2 * 10/2011 Hehenberger ..... B29B 9/16 166/245
8,601,711 B2 * 12/2013 Kim ..... F26B 11/0404 166/302
9,328,211 B2 * 5/2016 Nemoto ..... C08B 15/04
9,347,707 B2 * 5/2016 Struschka ..... F26B 5/06
9,429,362 B2 * 8/2016 Kanai ..... F26B 17/22
9,782,705 B2 * 10/2017 Thrasher ..... B01D 33/067
9,835,374 B2 * 12/2017 Swanson ..... F26B 11/0477
10,041,732 B2 * 8/2018 Shortt ..... F26B 5/08
10,119,762 B2 * 11/2018 Aaron ..... F26B 5/08
2018/0209733 A1 * 7/2018 Fliegl, Jr. ..... F26B 11/04

FOREIGN PATENT DOCUMENTS

DE 102016105538 A1 * 5/2017 ..... F26B 11/04
EP 2096394 A1 2/2009
EP 2805631 11/2014
WO WO-2017162430 A2 * 9/2017 ..... F26B 11/04

* cited by examiner

DRIER

TECHNICAL FIELD

The invention relates to a drying device for a mixture of a liquid and one or more solids.

BACKGROUND

In agriculture or biogas generation, for example, significant quantities of mixtures of liquids and solids arise, such as (sewage) sludge, liquid manure, or fermentation residue, which must be transported, disposed of, and/or processed. In order to keep in particular transport and storage costs for these mixtures as low as possible, it is known to thicken the mixtures by reducing the liquid portion in the mixtures in a targeted manner. This may be achieved, for example, by at least partial evaporation of this liquid portion.

For thickening via partial evaporation of the liquid portion of a mixture, for example a generic drying device may be used which includes a receiving container for accommodating the mixture, a rotor that is situated with one section of its circumference in the receiving container, and a drive device for rotatively driving the rotor. Such a drying device is known from DE 20 2009 018 720 U1, for example. In the drying device cited therein, the rotor is designed as a blade wheel, wherein due to the rotation of the rotor, several of the blades submerge on a continuous basis into the mixture to be thickened and entrain a portion of it, and the mixture suspended on the blades is exposed to an increased evaporative effect on the section of the circumference of the rotor that is not submerged in the mixture; this evaporative effect is attributed to the large-surface, thin-layered distribution on the blades. This evaporative effect is also significantly assisted by the action of an air stream, which is generated by a blower and which may also be heated, on the mixture that is suspended on the blades.

SUMMARY

The object of the invention is to improve a genetic drying device with regard to its effectiveness.

This object is achieved by means of a drying device according to claim 1. Advantageous embodiments of the drying device according to the invention are the subject matter of the dependent claims, and result following description of the invention.

A generic drying device for a mixture of a liquid and one or more solids, including at least one receiving container for the mixture, a rotor which with one section of its circumference (circumferential section) is situated in the receiving container, and a drive device for rotatively driving the rotor, wherein the rotor has a plurality of flat entrainment elements, is characterized according to the invention in that the entrainment elements have a radial orientation with respect to a rotational axis of the rotor, wherein at least some, preferably all, of the entrainment elements have a configuration in which relatively narrow entrainment elements alternate with relatively wide entrainment elements in the circumferential direction, and/or at least some, and preferably all, of the entrainment elements are provided with a plurality of through openings.

The entrainment elements are preferably immovably integrated into the rotor and/or preferably have a (in particular flat) plate-shaped design with a length (extension along the rotational axis of the rotor) and a width (one of the extensions perpendicular to the longitudinal direction) that are significantly greater, in particular at least ten times greater, than the height (extension perpendicular to the longitudinal direction and to the width direction).

A "radial" orientation is understood to mean an orientation of the flat, preferably plate-shaped entrainment elements in which a width direction of the entrainment elements has at least one directional component that is oriented precisely radially with respect to the rotational axis.

As a result of the entrainment elements having a radial orientation, and at the same time relatively narrow entrainment elements alternating with relatively wide entrainment elements in the circumferential direction, the surface area that is wettable by the mixture may be significantly increased compared to the drying device known from DE20 2009 018 720 UT. This is due to the fact that, on account of the radial orientation of the entrainment elements, their distances from one another decrease with increasing proximity to the rotational axis; for relatively widely dimensioned entrainment elements (which is basically preferred for achieving preferably large wettable surface areas of the entrainment elements), this would result in strong convergence and possibly also contact of the entrainment elements at their proximal ends with respect to the rotational axis, but would in turn hinder flow of the gas stream and in particular the air stream provided for evaporating a liquid portion of the mixture, through the spaces formed between the entrainment elements. Such a strong convergence of adjoining entrainment elements may be avoided according to the invention by using relatively narrow and relatively wide entrainment elements in alternation, all of these entrainment elements being positioned at the farthest possible radially outward location. This allows use of a comparatively large number of entrainment elements, as the result of which the total surface area formed by the entrainment elements may be maximized.

In addition, due to a design of the entrainment elements with a plurality of through openings, the gas stream provided for drying the mixture can flow not only through the spaces formed between the entrainment elements, but also through the entrainment elements themselves and thus also through the mixture adhering thereto, so that the drying effect of the drying device may likewise be significantly improved compared to entrainment elements through which flow cannot pass. Such an advantageous effect of entrainment elements through which flow can pass may have a positive impact, in particular when a relatively large number of entrainment elements is integrated, which is made possible by the design of alternating relatively narrow and relatively wide entrainment elements, since the distances between adjoining entrainment elements may thus be selected to be particularly small without this adversely affecting the overall flowthrough capability of the rotor and the mixture accommodated therein.

For generating a relatively large gas stream, it may preferably be provided that the drying device according to the invention has a blower that generates a gas stream and in particular an air stream that flows, at least partially and preferably completely, through the rotor or at least through the section thereof situated outside the receiving container. It may preferably be provided that the main flow direction of the gas stream is oriented transversely (preferably ≥45° and in particular perpendicularly with respect to the rotational axis of the rotor. Alternatively, however, the main flow direction of the gas stream may also be oriented in the longitudinal direction (≤45°) of the rotor (or of the rotational axis), and in particular also in parallel to the rotational axis.

In one preferred embodiment of a drying device according to the invention, it may be provided that the entrainment elements have an at least partial grid-shaped design. "Grid-shaped" is understood to mean a design in which the entrainment elements or the corresponding portion thereof are/is formed from a plurality of interconnected plate-shaped or rod-shaped elements which mutually delimit the plurality of through openings. "Rod-shaped" elements are characterized in that their length (i.e., the extension in one direction, the longitudinal direction) is significantly greater, in particular at least two times greater, than the width (one of the extensions perpendicular to the longitudinal direction) and the height (the extension perpendicular to the longitudinal direction and the width direction). The width may also preferably be significantly greater, and in particular at least two times greater, than the height. Grid-shaped entrainment elements may be characterized in particular by a relatively large ratio of the overall opening surface area formed by the plurality of through openings to the total surface area of the sides of the entrainment elements encompassing these through openings; at the same time, sufficient stability of the entrainment elements may be ensured. It may preferably be provided that for maximizing the ratio of the overall opening surface area to the total surface area, the height of the plate-shaped or rod-shaped elements, which form the grid shape of the entrainment elements, defines the distance between adjoining through openings. The elements may be designed, for example, in the form of a "parallel grid" having elements extending next to one another in parallel and thus having rectangular and in particular square opening cross sections, or in the form of a diamond-shaped grid having elements extending nonparallel and thus having in particular diamond-shaped opening cross sections.

In another preferred embodiment of a drying device according to the invention, it may also be provided that at least part, preferably all, of the entrainment elements have an inclined radial orientation with respect to the rotational axis of the rotor. An "inclined radial" orientation is understood to mean that in each case the distal end of the entrainment elements with respect to the rotational axis is offset compared to the respective proximal end in the circumferential direction. It may particularly preferably be provided that the entrainment elements are inclined in the direction of a provided rotational direction of the rotor. Once again an advantageous flow through spaces formed in particular between the entrainment elements is achieved with such a design. This may be the case in particular when the drying device according to the invention also includes a blower, the main flow direction of the gas stream generated by this blower being oriented transversely and in particular perpendicularly with respect to the rotational axis of the rotor. In addition, improved entrainment of a portion of the mixture from the receiving container may be achieved by such an inclined radial orientation of the entrainment elements.

It may preferably be provided that at least some, preferably all, through openings of the entrainment elements have an opening surface area of at least 800 $mm^2$ and/or at most 1600 $mm^2$. This has been shown to be a particularly advantageous compromise between preferably good flowthrough capability of the entrainment elements and a preferably good effect with regard to entrainment of the mixture from the receiving container.

To further improve the drying effect for a drying device according to the invention, it may be provided that the drying device also includes a heat exchanger via which a gas stream that is provided for the drying and in particular generated by a blower may be heated. Such a heat exchanger may be designed in the form of a heating device in which a conversion of energy in some other form (electrical energy, for example) into heat energy takes place. However, it may particularly advantageously be provided that (only) heat transfer from a heat exchange medium (in particular a fluid, i.e., a liquid or a gas or a mixture of liquid and gas) to the gas stream takes place in the heat exchanger. The heat energy stored in the heat exchange medium may particularly preferably be waste heat from another, in particular exothermic, process that is preferably carried out in the immediate vicinity of the drying device according to the invention. This other process may, for example, be combustion of biogas or some other fuel for power and/or heat generation.

A drying device according to the invention may preferably have a weighing device for determining the mass of the mixture contained in the receiving container, since the extent of drying of the mixture that has already taken place may thus be determined particularly accurately. This design is in principle independent of the design according to the invention of the drying device, and therefore may be advantageously implemented in any given generic drying devices.

For a drying device according to the invention it may also preferably be provided that the receiving container has an inlet, which in particular is used solely as an inlet, and an outlet, which in particular is used solely as an outlet, for the mixture. Compared to a drying device in which a combined inlet and outlet is used for feeding the mixture into the receiving container and discharging the mixture from the receiving container, in particular the most complete discharge possible of the dried, and thus not readily flowable, mixture may be improved in this way.

It may particularly preferably be provided that the inlet and the outlet are integrated into opposite sides of the receiving container, wherein these sides of the receiving container may be situated in particular at a distance from one another along the rotational axis of the rotor. Discharging an already dried batch of the mixture from the receiving container may thus be assisted by simultaneous feeding of a new batch.

The separately provided inlets and outlets involve a design that is in principle independent of the design according to the invention of the drying device, and therefore may be advantageously implemented in any given generic drying devices.

The indefinite articles "a" and "an," in particular in the claims and in the description providing a general explanation of the claims, are understood as such, and not as numerals. Accordingly, for components specified in this way it is understood that the components are present at least singly, and may be present in multiples.

BRIEF DESCRIPTION OF THE DRAWINGS

The invention is explained in greater detail below with reference to one exemplary embodiment illustrated in the drawings, which show the following.

DETAIL DESCRIPTION

Figure 4:
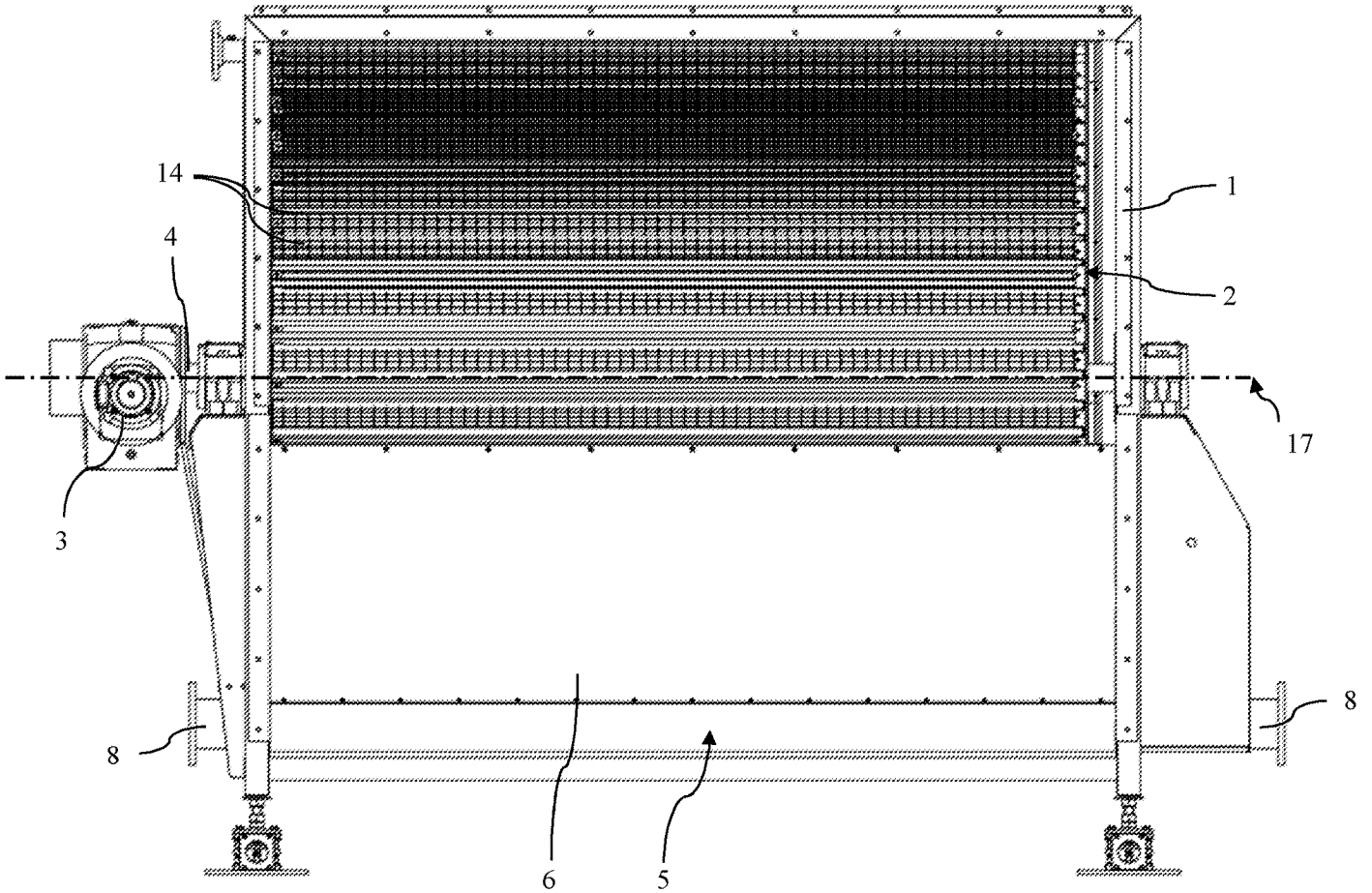
FIG. 4: shows the drying device in a view from the front.

The drying device illustrated in the drawings includes a frame 1 within which a rotor 2 is rotatably supported. A rotating drive of the rotor 2 may be provided by means of a drive device 3 (see FIG. 4) which may include an electric motor, for example, that may act directly, or with the connection of a step-up gear in between, on a central drive shaft 4 whose longitudinal axis corresponds to the rotational axis 17 of the rotor The frame 1 also integrates a receiving container 5 having a container shell 6, in the shape of a half-shell, whose two (longitudinally axial) ends are closed by means of boundary walls 7. The receiving container 5 is positioned beneath the rotor 2 (with respect to the gravitational direction in an intended operating position of the drying device), the rotor 2 being situated partially inside the receiving container 5.

The internal volume delimited by the receiving container 5 is fluidically connected to two connecting flanges 8 via which a mixture 9 of a liquid and one or more solids may be fed and discharged. One of the connecting flanges 8 is used for discharging mixture 9 that has already been thickened by means of the drying device according to the invention, and accordingly forms an outlet of the receiving container 5, while the other connecting flange 8 is used for feeding new mixture 9 yet to be thickened, and accordingly forms an inlet of the receiving container 5. The connecting flanges 8 are integrated into the sides (boundary walls 7) of the receiving container 5 which are spaced apart from one another along the rotational axis 17 of the rotor 2, and which are opposite from one another and oriented in parallel. One or more pumps or conveying devices (not illustrated) may be provided for feeding and discharging the mixture 9.

Fastened to the frame 1 on one side, at the level of the section of the rotor 2 situated outside the receiving container 5, is a device that includes a plurality of blowers 10 (in this case, two) and a heat exchanger 11. By means of the blowers 10, which may be driven by an electric motor, for example, an air stream may be generated which is oriented approximately perpendicularly with respect to the rotational axis 17 of the rotor 2 and which thus flows through the section of the rotor 2 outside the receiving container 5, transversely with respect to the rotational axis 17 of the rotor. The air stream also flows beforehand through the heat exchanger 11, thus heating the air stream by a transfer of heat energy from a heat exchange medium that is conducted within the heat exchanger 11 and conveyed through the heat exchanger 11 by a circulation pump, for example (not illustrated). To achieve a preferably directed flow through the rotor 2, the device also includes a housing 12 which not only ensures fastening of the device to the frame 1 and fixed positioning of the blower 10 and the heat exchanger 11 with respect to one another, but also has a flow-conducting functionality.

Figure 5:
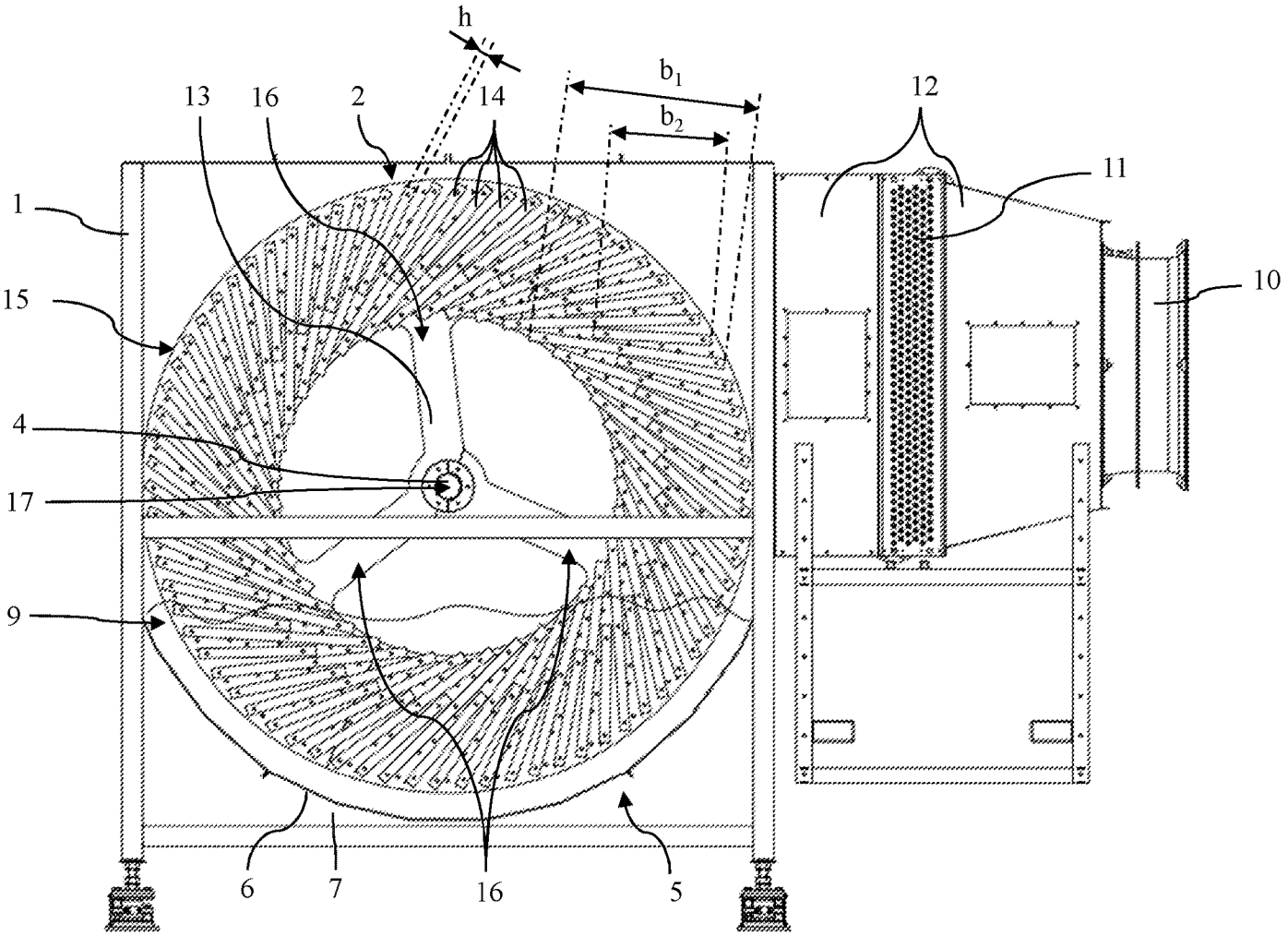
FIG. 5: shows the drying device in a side view, but without an illustration of one of the end-face walls of the rotor and one of the boundary walls of the frame of the drying device.

The rotor 2 includes two end-face walls 13 which delimit an internal volume of the rotor 2 on the end-face side and which are connected to one another by a plurality of plate-shaped entrainment elements 14 that are uniformly distributed over the outer circumference of the rotor 2 with an inclined radial orientation with respect to the rotational axis 17 in the rotational direction of the rotor 2 (see in particular FIG. 5). The plate-shaped entrainment elements have a flat, i.e., noncurved, design.

As is also apparent from FIG. 5, the (inclined) radial orientation of the entrainment elements 14 results in an increasing convergence of adjoining entrainment elements 14 with decreasing distance from the rotational axis 17. As a result, the number of entrainment elements 14 that are integratable into the rotor 2 is limited not only by the height h but also by the widths $b_1$, $b_2$ of the entrainment elements 14. In order to preferably make maximum use of the annular space of the rotor 2 within which the entrainment elements 14 are situated and which is provided in sections for submerging into the mixture 9 that is provided in the receiving container 5, for integration of a preferably large number of entrainment elements 14, thereby maximizing the surface area that is wettable by the mixture 9, it is provided that relatively wide entrainment elements 14 (having a width $b_1$) alternate with relatively narrow entrainment elements 14 (having a width $b_2$) in the circumferential direction of the rotor 2, the narrow entrainment elements 14 each being situated within an approximately V-shaped space which in each case forms adjoining relatively wide entrainment elements 14.

Due to the comparatively large total surface area which is formed by the plate-shaped entrainment elements 14 and which is available for entrainment of the mixture 9 to be thickened, and around which the air stream may flow, a correspondingly good drying or evaporative effect for the liquid portion of the mixture 9 may be achieved.

Figure 1:
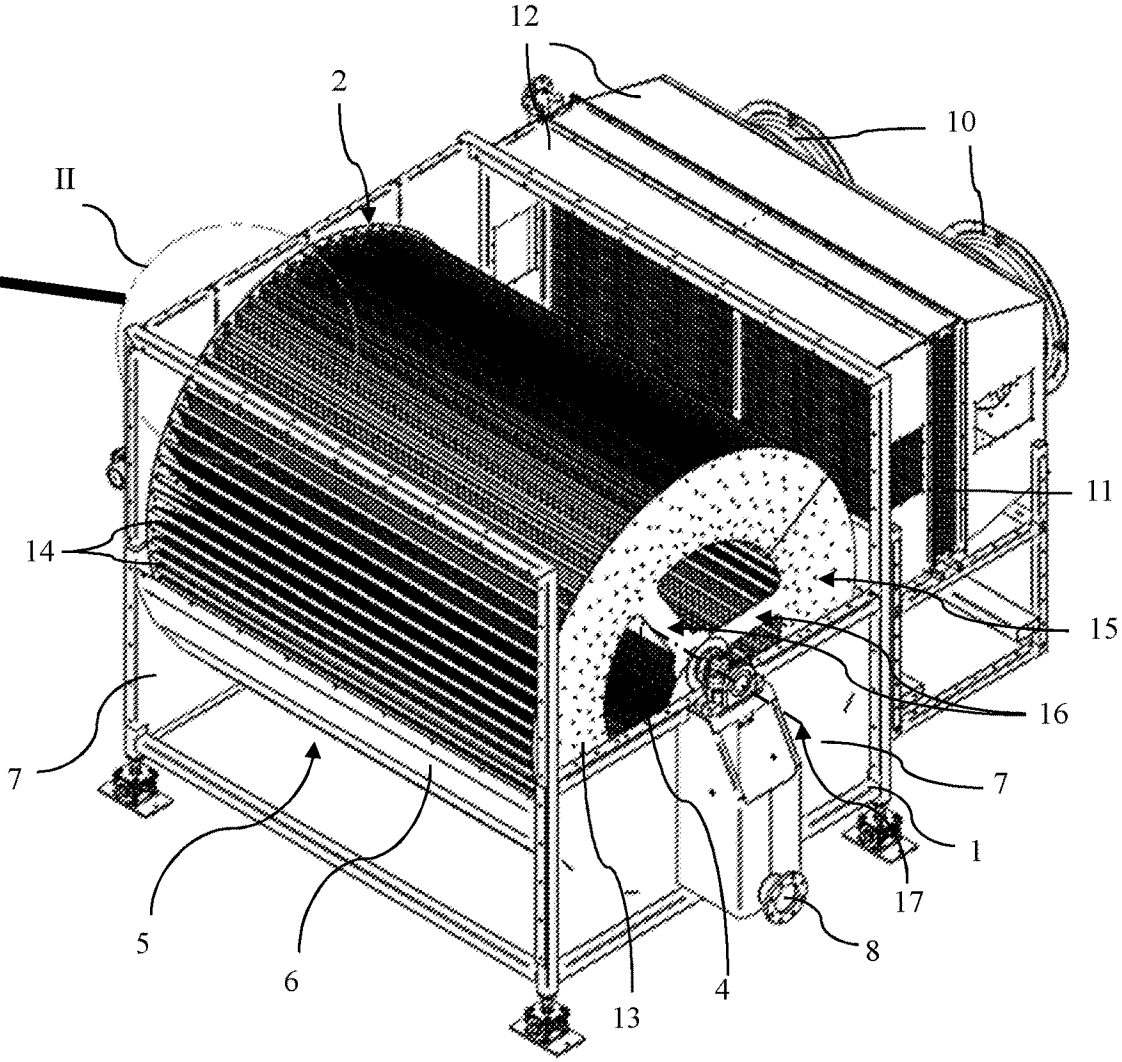
FIG. 1: shows a drying device according to the invention in a first perspective view.
Figure 2:
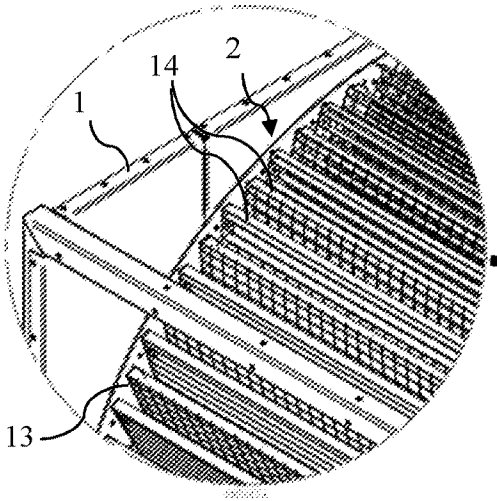
FIG. 2: shows the detail denoted by reference numeral II in FIG. 1 in an enlarged illustration.
Figure 3:
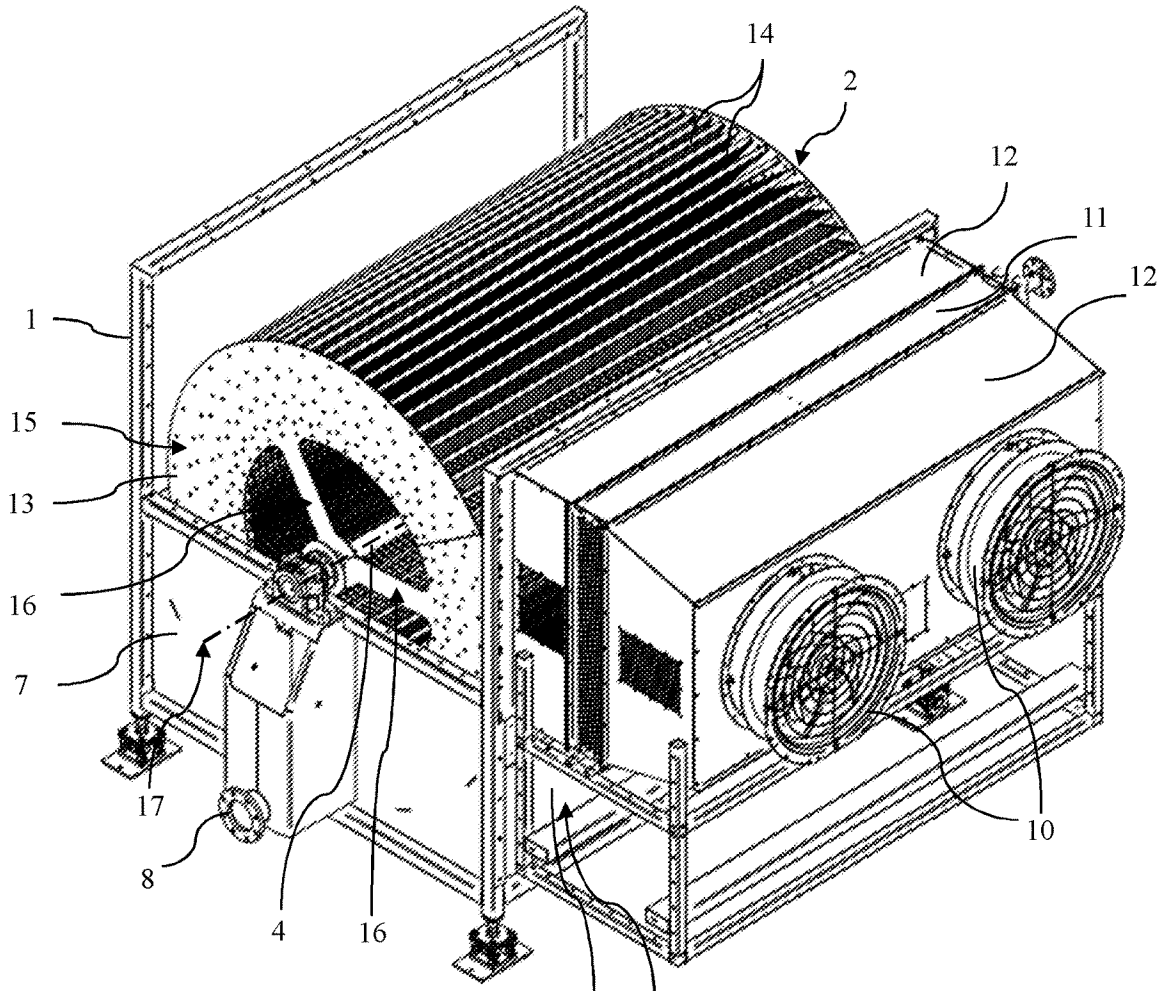
FIG. 3: shows the drying device in a second perspective view.

In addition, in the drying device, despite the relatively large distances between the entrainment elements 14 that result from the relatively large number of entrainment elements 14 that are integrated into the rotor 2, an overall good flow of the air stream through the rotor 2 and the mixture 9 that is entrained by the entrainment elements 14 results due to the entrainment elements 14 having a grid-shaped, in particular a cross grid-shaped, design (see in particular FIG. 2). Accordingly, all of the entrainment elements 14 are completely formed from a plurality of plate-shaped elements which, with the exception of the elements that form the edges of the entrainment elements 14, are connected crosswise to one another and which thus delimit a plurality of mutually penetrating through openings which are rectangular with respect to the longitudinal direction and the width direction of the individual entrainment elements 14, and which form straight longitudinal rows and straight transverse rows.

The end-face walls 13 have ring-shaped sections 15 in which the end-face walls are connected to one another by means of the entrainment elements 14. These ring-shaped sections 15 of the end-face walls 13 are connected to the drive shaft 4 via a plurality of radially oriented braces 16 in order to transfer the rotating drive of the drive shaft 4 to the ring-shaped sections 15 of the rotor 2 which are fastened to the entrainment elements 14.

During operation of the drying device, the rotor 2 is rotatively driven by means of the drive device 3, as the result of which another section of the rotor 2 is submerged on a continuous basis into the mixture 9 accommodated within the receiving container 5, and the entrainment elements 14 thus wetted with the mixture 9 are subsequently moved along the section of the circumference of the rotor 2 not situated in the receiving container 5, the heated air stream flowing around and through the entrainment elements, thus evaporating a portion of the liquid in the mixture 9. The desired thickening of the batch of the mixture 9 contained in the receiving container 5 is achieved in this way. This takes place until the batch of the mixture 9 contained in the receiving container 5 has reached a defined consistency or viscosity. The corresponding batch of the mixture 9 may then be discharged from the receiving container 5 via one of the connecting flanges 8, and a new batch may be fed via the other connecting flange 8 and then appropriately thickened by operating the drying device.

The consistency or viscosity of the mixture 9 to be achieved may be ascertained, for example, by determining a filling level of the mixture 9 within the receiving container 5 that is below a defined level. For determining the filling level, the drying device may have a corresponding filling level measuring device (not illustrated) which may include a radar device, for example. Determining the filling level or the consistency to be achieved may alternatively or additionally be based on weighing the receiving container 5 or the mixture 9 contained in the receiving container 5. The operation of the drying device, including the feeding and discharge of the various batches of the mixture 9 and optionally interrupting the rotating drive of the rotor 2 during the batch change, may thus take place in an automated manner.

The heat energy transferred to the air stream in the heat exchanger 11 preferably represents waste heat from an exothermic process, such as combustion of biogas or some other fuel for power and/or heat generation, that is particularly preferably carried out in the vicinity of the drying device.

Since security systems which reliably prevent escape of mixtures to be thickened by means of a drying device according to the invention must often be provided due to regulatory requirements, among other reasons, in addition to a filling level measuring device that is based on a radar sensor, for example, a further overfill safety device (not illustrated) may be provided for the receiving container 5. This overfill safety device may be based on an oscillating fork, for example, which may be continuously set in oscillation in a known manner, the frequency and/or amplitude of this oscillation changing due to contact with the mixture 9, by means of which an exceedance of a maximum filling level may be detected, which may subsequently result in forced shut-off, for example, of a pump that is to convey the mixture 9 into the receiving container 5. These types of fork sensors are authorized under the German Water Act.

Due to the option for fully automatic operation of the drying device, the drying device may preferably also have an interface (not illustrated) by means of which the drying device may be connected to a higher-level controller. For example, a malfunction report may also be output to a control device via this interface. There is likewise the option for controlling via the interface an agitator unit in a final storage facility in which the thickened mixture 9 is to be stored, as a function of the operation of the drying device. In addition, a drying device according to the invention may also be equipped with a heat flow meter. Such a heat flow meter, in particular in combination with an automatic device for determining the consistency of the mixture 9, may also be used for determining the drying power of the drying device. This may be relevant in particular when the drying device is equipped with a heating device for generating the gas stream used for drying, since in that case the drying power may be set in relation to the heat energy used.

A drying power of one liter of water per kilowatt-hour of heat energy, or better, may be achieved by means of a device according to the invention as illustrated in the drawings, for example. This value is much better than the one and one-half liters of water per kilowatt-hour of heat energy, which must currently be demonstrated as the drying power in order to obtain a cogeneration bonus under the German Renewable Energy Act.

LIST OF REFERENCE NUMERALS

1 frame
2 rotor
3 drive device
4 drive shaft
5 receiving container
6 container shell
7 boundary wall
8 connecting flange
9 mixture
10 blower
11 heat exchanger
12 housing
13 end-face wall of the rotor
14 entrainment element of the rotor
15 ring-shaped section of the end-face wall of the rotor
16 brace for the end-face wall of the rotor
17 rotational axis of the rotor
b1 width of a relatively wide entrainment element
b2 width of a relatively narrow entrainment element
h height of an entrainment element

The invention claimed is:

1. A drying device for a mixture of a liquid and one or more solids, having a receiving container for the mixture, a rotor that is situated with only a section of a circumference of the rotor in the receiving container, and a drive device for rotatively driving the rotor, the rotor having a plurality of flat entrainment elements, characterized in that the entrainment elements have a radial orientation with respect to a rotational axis of the rotor, wherein at least some of the entrainment elements have a configuration in which relatively narrow entrainment elements alternate with relatively wide entrainment elements in a circumferential direction of the rotor, and/or at least some of the entrainment elements are provided with a plurality of through openings.

2. The drying device according to claim 1, characterized in that the entrainment elements have a grid-shaped design.

3. The drying device according to claim 1, characterized in that the entrainment elements have an inclined radial orientation with respect to the rotational axis of the rotor such that in each case the distal end of the entrainment elements with respect to the rotational axis is offset compared to the respective proximal end in the circumferential direction.

4. The drying device according to claim 3, characterized in that the entrainment elements are inclined in a direction of a provided rotational direction of the rotor.

5. The drying device according to claim 1, characterized in that through openings of the entrainment elements have an opening surface area of at least 800 $mm^2$ and/or at most 1600 $mm^2$.

6. The drying device according to claim 1, characterized by a weighing device for determining a mass of the mixture contained in the receiving container.

7. The drying device according to claim 1, characterized in that the receiving container has an inlet and an outlet for the mixture.

8. The drying device according to claim 7, characterized in that the inlet and the outlet are integrated into opposite sides of the receiving container.

9. The drying device according to claim 8, characterized in that the sides of the receiving container are spaced apart from one another along the rotational axis of the rotor.

10. The drying device according to claim 3, characterized in that the distal end as well as the proximal end are represented by edges of the entrainment elements which run parallel to the rotational axis of the rotor.

11. The drying device according to claim 1, characterized in that the rotor includes two end-face walls which delimit an internal volume of the rotor on the end-face side and which are connected to one another by the entrainment elements.

12. The drying device according to claim 1, characterized in that the drive device includes an electric motor for rotatively driving the rotor.

13. The drying device according to claim 1, characterized by at least one blower, which is arranged to generate a gas stream which flows at least partially through a section of the rotor situated outside the receiving container.

14. The drying device according to claim 13, characterized in that a main flow direction of the gas stream is oriented transversely with respect to the rotational axis of the rotor.

15. The drying device according to claim 13, characterized by a heat exchanger, which is situated between the at least one blower and the rotor such that the air stream flows through the heat exchanger before flowing through the section of the rotor being outside the receiving container.

16. The drying device according to claim 1, characterized in that the entrainment elements, which have a configuration in which relatively narrow entrainment elements alternate with relatively wide entrainment elements in the circumferential direction of the rotor, are arranged such that each relative narrow entrainment elements is positioned between two relative wide entrainment elements.

17. The drying device according to claim 1, characterized in that radially outer edges of the entrainment elements define the circumference of the rotor.

* * * * *